US006194362B1

(12) United States Patent
Trinh et al.

(10) Patent No.: US 6,194,362 B1
(45) Date of Patent: Feb. 27, 2001

(54) GLASS CLEANING COMPOSITIONS CONTAINING BLOOMING PERFUME

(75) Inventors: Toan Trinh, Maineville; Dennis Ray Bacon, Milford; Patricia Ann Blondin, Fairfield; Alex Haejoon Chung, West Chester; Michael Stephen Maile, Maineville; Ronald Anthony Masters, Loveland, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/025,229

(22) Filed: Feb. 18, 1998

Related U.S. Application Data

(63) Continuation-in-part of application No. 08/618,523, filed on Mar. 19, 1996, now abandoned.

(51) Int. Cl.[7] ..... C11D 3/50; C11D 9/44

(52) U.S. Cl. ..... 510/101; 510/102; 510/103; 510/104; 510/105; 510/106; 510/107; 510/181; 510/182

(58) Field of Search ..... 510/101, 102, 510/103, 104, 105, 106, 107, 181, 182

(56) References Cited

U.S. PATENT DOCUMENTS

| | | | |
|---|---|---|---|
| 4,287,080 | 9/1981 | Siklosi | 252/104 |
| 4,396,522 | 8/1983 | Callicott et al. | 252/163 |
| 4,515,705 | 5/1985 | Moeddel | 252/174.12 |
| 4,874,536 | 10/1989 | Strickland, Jr. et al. | 252/90 |
| 4,946,672 | 8/1990 | Gibbs | 424/76.1 |
| 4,992,198 | 2/1991 | Nebashi et al. | 252/174.11 |
| 5,035,826 | 7/1991 | Durbut et al. | 252/121 |
| 5,057,152 | 10/1991 | Marcus et al. | 106/3 |
| 5,066,419 | 11/1991 | Walley et al. | 252/174.11 |
| 5,076,954 | 12/1991 | Loth et al. | 252/122 |
| 5,089,162 | 2/1992 | Rapisarda et al. | 252/102 |
| 5,108,643 | 4/1992 | Loth et al. | 252/174.11 |
| 5,139,687 | 8/1992 | Borgher, Sr. et al. | 252/8.6 |
| 5,143,900 | 9/1992 | Steltenkamp et al. | 513/26 |
| 5,154,842 | 10/1992 | Walley et al. | 252/8.6 |
| 5,171,475 | 12/1992 | Freiesleben | 252/312 |
| 5,188,753 | 2/1993 | Schmidt et al. | 252/132 |
| 5,190,915 | 3/1993 | Behan et al. | 512/2 |
| 5,213,624 | 5/1993 | Williams | 134/40 |
| 5,232,613 | 8/1993 | Bacon et al. | 252/8.6 |
| 5,234,610 | 8/1993 | Gardlik et at. | 252/8.6 |
| 5,238,843 | 8/1993 | Carpenter et al. | 435/264 |
| 5,246,611 | 9/1993 | Trinh | 252/8.6 |
| 5,254,284 | 10/1993 | Blandiaux et al. | 252/545 |
| 5,336,665 | 8/1994 | Garner-Gray et al. | 512/4 |
| 5,342,549 | 8/1994 | Michael | 252/546 |
| 5,350,541 | 9/1994 | Michael et al. | 252/549 |
| 5,374,614 | 12/1994 | Behan et al. | 512/3 |
| 5,382,376 | 1/1995 | Michael et al. | 252/153 |
| 5,384,186 | 1/1995 | Trinh | 428/240 |
| 5,454,983 | 10/1995 | Michael et al. | 252/545 |
| 5,460,743 | 10/1995 | Delwel et al. | 252/174.23 |
| 5,462,690 | 10/1995 | Rhinesmith | 252/126 |
| 5,462,697 | 10/1995 | Yianakopoulos | 252/528 |
| 5,466,390 | 11/1995 | Houghton et al. | 252/174.11 |
| 5,500,138 | 3/1996 | Bacon et al. | 252/8.8 |
| 5,536,451 | 7/1996 | Masters et al. | 510/405 |
| 5,554,588 | 9/1996 | Behan et al. | 512/1 |
| 5,676,163 | 10/1997 | Behan et al. | 131/213 |

FOREIGN PATENT DOCUMENTS

| | | | |
|---|---|---|---|
| 0 080 749 A1 | 6/1983 | (EP) | C11D/3/20 |
| 0 344 847 A2 | 12/1989 | (EP) | C11D/3/43 |
| 0 545 556 A2 | 6/1993 | (EP) | A61K/7/46 |
| WO 95/15186 | 11/1993 | (WO) | A61L/9/01 |
| WO 94/19449 | 2/1994 | (WO) | C11D/17/00 |
| WO 94/28107 | 12/1994 | (WO) | C11D/3/50 |

OTHER PUBLICATIONS

Methods of Calculating Partition Coefficients, Section 18.7, A. J. Leo, Pomona College, Claremont, California, pp. 295–319, 1990.

*Primary Examiner*—Richard L. Raymond
*Assistant Examiner*—Brenda Coleman
(74) *Attorney, Agent, or Firm*—Jason J. Camp

(57) ABSTRACT

The present invention relates to a glass cleaning composition comprising: from about 0.001% to about 3% of a blooming perfume composition comprising at least about 50% of blooming perfume ingredients selected from the group consisting of: ingredients having a boiling point of less than about 260° C. and a ClogP of at least about 3, and wherein said perfume composition comprises at least 5 different blooming perfume ingredients; from about 0.001% to about 2% of detergent surfactant system selected from the group consisting of anionic surfactants, amphoteric detergent surfactants including zwitterionic surfactants; and mixtures thereof; from about 0.5% to about 30% of hydrophobic solvent; and the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients. These compositions have good filming/streaking characteristics and provide a blooming perfume effect.

13 Claims, No Drawings

GLASS CLEANING COMPOSITIONS CONTAINING BLOOMING PERFUME

REFERENCE TO RELATED APPLICATIONS

This is a continuation-in-part of U.S. Ser. No. 08/618,523, filed Mar. 19, 1996 now abandoned.

TECHNICAL FIELD

This invention pertains to glass cleaning compositions, preferably liquid detergent compositions for use in cleaning glass, especially window glass, and, preferably, other hard surfaces. The compositions of the present invention comprise efficient blooming perfumes, a detergent surfactant system, solvents, builders, and water. The compositions contain naturally, and/or synthetically, derived perfumes which deliver a high level of consumer recognition immediately upon use.

BACKGROUND OF THE INVENTION

The use of, e.g., solvents and organic water-soluble synthetic detergent surfactants at low levels for cleaning glass are known. There are several compositions known that provide good filming/streaking characteristics so that the glass is cleaned without leaving objectionable levels of spots and/or films.

Known detergent compositions comprise certain organic solvents, detergent surfactants, and optional builders and/or abrasives. The prior art, however, fails to teach, or recognize, the advantage of providing an efficient blooming perfume in glass cleaner formulations to provide enhanced positive scent signal to consumers.

The preferred liquid cleaning compositions have the great advantage that they can be applied to hard surfaces in neat or concentrated form so that a relatively high level of, e.g., surfactant material and/or organic solvent is delivered directly to the soil. Therefore, liquid cleaning compositions have the potential to provide superior soap scum, grease, and oily soil removal over dilute wash solutions prepared from powdered cleaning compositions. The most preferred compositions are those that provide good cleaning on tough soils and yet clean glass without leaving objectionable levels of spots and/or films.

Liquid cleaning compositions, and especially compositions prepared for cleaning glass, need exceptionally good filming/streaking properties. In addition, they can suffer problems of product form, in particular, inhomogeneity, lack of clarity, or excessive "solvent" odor for consumer use.

SUMMARY OF THE INVENTION

The present invention relates to aqueous, liquid, hard surface detergent composition having improved cleaning and good filming/streaking characteristics comprising as essential ingredients:

(A) from about 0.001% to about 3%, preferably from about 0.01% to about 1%, more preferably from about 0.01% to about 0.5%, and even more preferably from about 0.01% to about 0.25%, of a blooming perfume composition comprising at least about 50%, more preferably at least about 60 wt. %, and even more preferably at least about 70 wt. % of blooming perfume ingredients selected from the group consisting of perfume ingredients having a boiling point of less than about 260° C. preferably less than about 255° C.; and more preferably less than about 250° C., and a ClogP of at least about 3, preferably more than about 3.1 and even more preferably more than about 3.2, and wherein said perfume composition comprises at least 5, preferably at least 6, more preferably at least 7, and even more preferably at least 8 or 9 or even 10 or more, different blooming perfume ingredients;

(B) from about 0.001% to about 2%, preferably from about 0.02% to about 1%, and more preferably from about 0.05% to about 0.2% of detergent surfactant selected from the group consisting of anionic surfactants, amphoteric detergent surfactants including zwitterionic surfactants; and mixtures thereof; and (C) from about 0.5% to about 30%, preferably from about 2% to about 15%, more preferably from about 3% to about 8% of hydrophobic solvent.;

(D) the balance being an aqueous solvent system comprising water and, optionally, non-aqueous polar solvent with only minimal cleaning action selected from the group consisting of methanol, ethanol, isopropranol, ethylene glycol, propylene glycol, glycol ethers having a hydrogen bonding parameter of greater than 7.7, and mixtures thereof and any minor ingredients.

All percentages and ratios used herein are by weight of the total composition unless otherwise indicated. All measurements made are at ambient temperature (25° C.), unless otherwise designated. The invention herein can comprise, consist of, or consist essentially of, the essential components as well as the optional ingredients and components described herein.

DETAILED DESCRIPTION OF THE INVENTION

The present invention relates to aqueous, liquid, hard surface detergent composition having improved cleaning and good filming/streaking characteristics, especially those suitable for cleaning glass windows, comprising as essential ingredients:

(A) from about 0.001% to about 3%, preferably from about 0.01% to about 1%, more preferably from about 0.01% to about 0.5%, and even more preferably from about 0.01% to about 0.25%, by weight of the, total composition, of a blooming perfume composition comprising at least about 50%, more preferably at least about 60 wt. %, and even more preferably at least about 70 wt. % of blooming perfume ingredients selected from the group consisting of perfume ingredients having a boiling point of less than about 260° C., preferably less than about 255° C.; and more preferably less than about 250° C., and a ClogP of at least about 3, preferably more than about 3.1, and even more preferably more than about 3.2 and wherein said perfume composition comprises at least 5, preferably at least 6, more preferably at least 7, and even more preferably at least 8 or 9 or even 10 or more different blooming perfume ingredients;

(B) from about 0.001% to about 2%, preferably from about 0.02% to about 1%, and more preferably from about 0.05% to about 0.2% of detergent surfactant selected from the group consisting of anionic surfactants, amphoteric detergent surfactants including zwitterionic surfactants; and mixtures thereof; and (C) from about 0.5% to about 30%, preferably from about 2% to about 15%, more preferably from about 3% to about 8% of hydrophobic solvent;

(D) the balance being an aqueous solvent system comprising water and, optionally, non-aqueous polar solvent with only minimal cleaning action selected from the group consisting of methanol, ethanol, isopropanol, ethylene glycol, propylene glycol, glycol ethers having a hydrogen bonding parameter of greater than 7.7, and mixtures thereof and any minor ingredients.

The compositions of the present invention can also include optional ingredients to enhance specific characteristics as described hereinafter.

Blooming Perfume Composition

The blooming perfume ingredients, as disclosed herein, can be formulated into glass cleaning compositions in order to provide significantly better noticeability to the consumer than nonblooming perfume compositions not containing a substantial amount of blooming perfume ingredients. Additionally, residual perfume is not desirable on many surfaces, including glass windows, mirrors, and countertops where spotting/fliming is undesirable.

A blooming perfume ingredient is characterized by its boiling point (B.P.) and its octanol/water partition coefficient (P). The octanol/water partition coefficient of a perfume ingredient is the ratio between its equilibrium concentrations in octanol and in water. The preferred perfume ingredients of this invention have a B.P., determined at the normal, standard pressure of about 760 mm Hg, of about 260° C. or lower, preferably less than about 255° C.; and more preferably less than about 250° C., and an octanol/water partition coefficent P of about 1,000 or higher. Since the partition coefficients of the preferred perfume ingredients of this invention have high values, they are more conveniently given in the form of their logarithm to the base 10, logP at 25° C. Thus the preferred perfume ingredients of this invention have logP of about 3 or higher, preferably more than about 3.1, and even more preferably more than about 3.2.

Boiling points of many perfume compounds can be found in the following sources:

Properties of Organic Compounds Database CD-ROM Ver. 5.0 CRC Press Boca Raton, Fla.

Flavor and Fragrance—1995 Aldrich Chemical Co. Milwaukee, Wis.

STN database/on-line Design Institute of for Physical Property Data American Institute of Chemical Engineers STN database/on-line Beilstein Handbook of Organic Chemistry Beilstein Information Systems Perfume and Flavor Chemicals Steffen Arctander Vol. I,II—1969

When unreported, the 760 mm boiling points of perfume ingredients can be estimated. The following computer programs are useful for estimating these boilings points:

MPBPVP Version 1.25 © 1994–96 Meylan Syracuse Research Corporation (SRC) Syracuse, N.Y.

ZPARC ChemLogic, Inc. Cambridge, Mass.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the Pamona Med Chem/Daylight "CLOGP" program, Version 4.42 available from Biobyte Corporation, Claremont, Calif. This program also lists experimental logP values when they are available in the Pomona92 database. The "calculated logP" (ClogP) is determined by the fragment approach of Hansch and Leo ( cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

Thus, when a perfume composition which is composed of ingredients having a B.P. of about 260° C. or lower and a ClogP, or an experimental logP, of about 3 or higher, is used in an automatic dishwashing detergent composition, the perfume is very effusive and very noticeable when the product is used.

Table 1 gives some non-limiting examples of blooming perfume ingredients, useful in glass cleaning compositions of the present invention. The glass cleaning compositions of the present invention contain from about 0.005% to about 3%, preferably from about 0.01% to about 1%, more preferably from about 0.01% to about 0.5%, and even more preferably from about 0.01% to about 0.25%, of blooming perfume composition. The blooming perfume compositions of the present invention contain at least 5, preferably at least 6, more preferably at least 7, and even more preferably at least 8 or 9 or even 10 or more different blooming perfume ingredients. Furthermore, the blooming perfume compositions of the present invention contain at least about 50 wt. % of blooming perfume ingredients, preferably at least about 55 wt. % of blooming perfume ingredients, more preferably at least about 60 wt. % of blooming perfume ingredients, and even more preferably at least about 70 wt. % or even 80% of blooming perfume ingredients. The blooming perfume compositions herein preferably should not contain any single ingredient al a level which would provide more than about 1%, by weight of that ingredient to tie total glass cleaning composition, more preferably not more than about 0.5%, by weight of the composition, and even more preferably not more than about 0.25%, by weight of the glass cleaning composition.

The perfume composition itself should preferably not contain more than 60% of any single perfume ingredient.

Most common perfume ingredients which are derived from natural sources are composed of a multitude of components. For example, orange terpenes contain about 90% to about 95% d-limonene, but also contain many other minor ingredients. When each such material is used in the formulation of blooming perfume compositions of the present invention, it is counted as one ingredient, for the purpose of defining the invention. Synthetic reproductions of such natural perfume ingredients are also comprised of a multitude of components and are counted as one ingredient for the purpose of defining the invention.

Some of the blooming perfume ingredients of the present invention can optionally, and less preferably, be replaced by "delayed blooming" perfume ingredients. The optional delayed blooming perfume ingredients of this invention have a B.P., measured at the normal, standard pressure, of about 260° C. or lower, preferably less than about 255° C.; and more preferably less than about 250° C., and a logP or ClogP of less than about 3. Thus, when a perfume composition is composed of some preferred blooming ingredients and some delayed blooming ingredients, the perfume effect is longer lasting when the product is used. Table 2 gives some non-limiting examples of optional delayed blooming perfume ingredients, useful in glass cleaning compositions of the present invention. Delayed blooming perfume ingredients are used primarily in applications where the water will evaporate, thus liberating the perfume.

When delayed blooming perfume ingredients are used in combination with the blooming perfume ingredients in the blooming perfume compositions of the present invention, the weight ratio of blooming perfume ingredients to delayed blooming perfume ingredients is typically at least about 1, preferably at least about 1.3, more preferably about 1.5, and even more preferably about 2. The blooming perfume compositions contain at least about 50 wt. % of the combined blooming perfume ingredients and delayed blooming perfume ingredients, preferably at least about 55 wt. % of the combined perfume ingredients, more preferably at least about 60 wt. % of the combined perfume ingredients, and even more preferably at least about 70 wt. % of the combined perfume ingredients. When some optional delayed blooming perfume ingredients are used in combination with the blooming perfume ingredients in the blooming perfume compositions, the blooming perfume compositions of the present invention contain at least 5 different blooming perfume ingredients and 2 different delayed blooming perfume ingredients, preferably at least 5 different blooming perfume ingredients and 3 different delayed blooming perfume ingredients, and more preferably at least 6 or 7 or even 9 or 10 or more different blooming perfume ingredients and 4 preferably 5, more preferably at least 6 or 7 or even 9 or 10 or more different delayed blooming perfume ingredients.

The glass cleaning compositions of the present invention contain from about 0.005% to about 3%, preferably from about 0.01% to about 1%, more preferably from about 0.01% to about 0.5%, and even more preferably from about 0.01% to about 0.25%, of perfume components.

In the perfume art, some auxiliary materials having no odor, or a low odor, are used, e.g., as solvents, diluents, extenders or fixatives. Non-limiting examples of these materials are ethyl alcohol, carbitol, dipropylene glycol, diethyl phthalate, triethyl citrate, isopropyl myristate, and benzyl benzoate. These materials are used for, e.g., solubilizing or diluting some solid or viscous perfume ingredients to, e.g., improve handling and/or formulating. These materials are useful in the blooming perfume compositions, but are not counted in the calculation of the limits for the definition/formulation of the blooming perfume compositions of the present invention.

Non-blooming perfume ingredients, which should be minimized in glass cleaning compositions of the present invention, are those having a B.P. of more than about 260° C. Table 3 gives some non-limiting examples of non-blooming perfume ingredients. In some particular glass cleaning compositions, some non-blooming perfume ingredients can be used in small amounts, e.g., to improve product odor.

In the following tables, measured boiling points are taken from the following sources:

Properties of Organic Compounds Database CD-ROM Ver. 5.0 CRC Press Boca Raton, Fla.

Flavor and Fragrance—1995 Aldrich Chemical Co. Milwaukee, Wis.

STN database/on-line Design Institute of for Physical Property Data American Institute of Chemical Engineers STN database/on-line Beilstein Handbook or Organic Chemistry Beilstein Information Systems Perfume and Flavor Chemicals Steffen Arctander Vol. I,II—1969

Estimated boilings points are an average of those determined by the following computer programs:

MPBPVP Version 1.25 © 1994–96 Meylan Syracuse Research Corporation (SRC)

ZPARC ChemLogic, Inc.

The predicted ClogP at 25° C. was determined by the following computer program:

Panoma MedChem/Daylight ClogP V. 4.42

TABLE 1

Sample of Blooming Perfume Ingredients

| Ingredient | ClogP (Pred.) | Boiling Pt. (Meas.) | Boiling Pt. (Pred.) |
|---|---|---|---|
| Allo-ocimene | 4.36 | | 195 |
| Allyl cyclohexanepropionate | 3.94 | | 252 |
| Allyl heptanoate | 3.40 | | 209 |
| trans-Anethole | 3.31 | 232 | |
| Benzyl butyrate | 3.02 | 240 | |
| Camphene | 4.18 | 160 | |
| Cadinene | 7.27 | | 252 |
| Carvacrol | 3.40 | 238 | |
| cis-3-Hexenyl tiglate | 3.80 | | 225 |
| Citronellol | 3.25 | 223 | |
| Citronellyl acetate | 4.20 | 234 | |
| Citronellyl nitrile | 3.09 | 226 | |
| Citronellyl propionate | 4.73 | | 257 |
| Cyclohexylethyl acetate | 3.36 | 222 | |
| Decyl Aldehyde (Capraldehyde) | 4.01 | 208 | |
| Dihydromyrcenol | 3.03 | 192 | |
| Dihydromyrcenyl acetate | 3.98 | | 221 |
| 3,7-Dimethyl-1-octanol | 3.74 | 205 | |
| Diphenyloxide | 4.24 | 259 | |
| Fenchyl Acetate (1,3,3-Trimethyl-2-norbornanyl acetate) | 3.53 | | 234 |
| Geranyl acetate | 3.72 | 233 | |
| Geranyl formate | 3.27 | | 231 |
| Geranyl nitrile | 3.25 | 228 | |
| cis-3-Hexenyl isobutyrate | 3.27 | | 204 |
| Hexyl Neopentanoate | 4.06 | | 213 |
| Hexyl tiglate | 4.28 | | 221 |
| alpha-Ionone | 3.71 | 237 | |
| Isobornyl acetate | 3.53 | 238 | |
| Isobutyl benzoate | 3.57 | 242 | |
| Isononyl acetate | 4.28 | | 220 |
| Isononyl alcohol (3,5,5-Trimethyl-1-hexanol) | 3.08 | 194 | |
| Isopulegyl acetate | 3.70 | | 243 |
| Lauraldehyde | 5.07 | 250 | |
| d-Limonene | 4.35 | 177 | |
| Linalyl acetate | 3.50 | | 230 |
| (-)-L-Menthyl acetate | 4.18 | 227 | |
| Methyl Chavicol (Estragole) | 3.13 | 216 | |
| Methyl n-nonyl acetaldehyde | 4.85 | 247 | |
| Methyl octyl acetaldehyde | 4.32 | | 224 |
| beta--Myrcene | 4.33 | | 165 |
| Neryl acetate | 3.72 | 236 | |
| Nonyl acetate | 4.41 | 229 | |
| Nonaldehyde | 3.48 | 191 | |
| p-Cymene | 4.07 | 173 | |
| alpha-Pinene | 4.18 | 156 | |
| beta--Pinene | 4.18 | 166 | |
| alpha-Terpinene | 4.41 | 175 | |
| gamma-Terpinene | 4.35 | 183 | |
| alpha-Terpinyl acetate | 3.58 | 220 | |
| Tetrahydrolinalool | 3.52 | 202 | |
| Tetrahydromyrcenol | 3.52 | 195 | |
| 2-Undecenal | 4.22 | | 235 |
| Verdox (o-t-Butylcyclohexyl acetate) | 4.06 | | 239 |
| Vertenex (4-tert.Butylcyclohexyl acetate) | 4.06 | | 237 |

TABLE 2

Examples of "Delayed Blooming" Perfume Ingredients

| Ingredient | ClogP (Pred.) | Boiling Pt. (Meas.) | Boiling Pt. (Pred.) |
|---|---|---|---|
| Allyl caproate | 2.87 | 186 | |
| Amyl acetate (n-Pentyl acetate) | 2.30 | 147 | |
| Amyl Propionate | 2.83 | 169 | |
| p-Anisaldehyde | 1.78 | 249 | |
| Anisole | 2.06 | 154 | |
| Benzaldehyde (Benzenecarboxaldehyde) | 1.50 | 179 | |
| Benzylacetate | 1.96 | 211 | |
| Benzyl acetone | 1.74 | 234 | |
| Benzyl alcohol | 1.10 | 205 | |
| Benzyl formate | 1.50 | 203 | |
| Benzyl isovalerate | 3.42 | | 256 |
| Benzyl propionate | 2.49 | 221 | |
| beta-gamma-Hexenol (2-Hexen-1-ol) | 1.40 | | 164 |
| (+)-Camphor | 2.18 | 207 | |
| (+)-Carvone | 2.01 | 231 | |
| L-Carvone | 2.01 | | 230 |
| Cinnamic alcohol | 1.41 | | 258 |
| Cinnamyl formate | 1.91 | 252 | |
| cis-Jasmone | 2.64 | | 253 |
| cis-3-Hexenyl acetate | 2.34 | | 175 |
| Citral (Neral) | 2.95 | 208 | |
| Cumic alcohol | 2.53 | 249 | |
| Cuminaldehyde | 2.92 | 235 | |
| Cyclal (2,4-Dimethyl-3-cyclohexene-1-carboxaldehyde) | 2.36 | | 203 |
| Dimethyl benzyl carbinol | 1.89 | 215 | |
| Dimethyl benzyl carbinyl acetate | 2.84 | | 248 |
| Ethyl acetate | 0.71 | 77 | |
| Ethyl acetoacetate | 0.33 | 181 | |
| Ethyl amyl ketone | 2.44 | 167 | |
| Ethyl benzoate | 2.64 | 215 | |
| Ethyl butanoate | 1.77 | 121 | |
| 3-Nonanone (Ethyl hexyl ketone) | 2.97 | 187 | |
| Ethyl phenylacetate | 2.35 | 228 | |
| Eucalyptol | 2.76 | 176 | |
| Eugenol | 2.40 | 253 | |
| Fenchyl alcohol | 2.58 | 199 | |
| Flor Acetate (Tricyclodecenyl acetate) | 2.36 | | 233 |
| Frutene (Tricyclodecenyl propionate) | 2.89 | | 250 |
| gamma-Nonalactone | 2.77 | 243 | |
| trans-Geraniol | 2.77 | 230 | |
| cis-3-Hexen-1-ol/Leaf Alcohol | 1.40 | 156 | |
| Hexyl acetate | 2.83 | 171 | |
| Hexyl formate | 2.38 | 155 | |
| Hydratopic alcohol | 1.58 | | 233 |
| Hydroxycitronellal | 1.54 | 241 | |
| Indole (2,3-Benzopyrrole) | 2.13 | 254 | |
| Isoamyl alcohol | 1.22 | 131 | |
| Isopropyl phenylacetate | 2.66 | | 237 |
| Isopulegol | 2.75 | | 231 |
| Isoquinoline (Benzopyridine) | 1.82 | 243 | |
| Ligustral (2,4-Dimethyl-3-Cyclohexene-1-carboxaldehyde) | 2.36 | | 204 |
| Linalool | 2.55 | 193 | |
| Linalool oxide | 1.45 | | 223 |
| Linalyl formate | 3.05 | | 212 |
| Menthone | 2.83 | | 214 |
| 4-Methylacetophenone | 2.08 | 226 | |
| Methyl pentyl ketone | 1.91 | 151 | |
| Methyl anthranilate | 2.02 | 256 | |
| Methyl benzoate | 2.11 | 199 | |
| Methyl Phenyl Carbinyl Acetate (alpha-Methylbenzyl acetate) | 2.27 | | 216 |
| Methyl Eugenol (Eugenyl methyl ether) | 2.67 | 254 | |
| Methyl Heptenone (6-Methyl-5-hepten-2-one) | 1.82 | 173 | |
| Methyl Heptine Carbonate (Methyl 2-octynoate) | 2.57 | 218 | |
| Methyl Heptyl ketone | 2.97 | 195 | |
| Methyl Hexyl ketone | 2.44 | 173 | |
| Methyl salicylate | 2.45 | 223 | |
| Dimethyl anthranilate | 2.16 | 255 | |
| Nerol | 2.77 | 225 | |
| delta-Nonalactone | 2.80 | | 226 |

TABLE 2-continued

Examples of "Delayed Blooming" Perfume Ingredients

| Ingredient | ClogP (Pred.) | Boiling Pt. (Meas.) | Boiling Pt. (Pred.) |
|---|---|---|---|
| gamma-Octalactone | 2.24 | 256 | |
| 2-Octanol | 2.72 | 180 | |
| Octyl Aldehyde (Caprylic aldehyde) | 2.95 | 167 | |
| p-Cresol | 1.97 | 202 | |
| p-Cresyl methyl ether | 2.56 | 175 | |
| Acetanisole | 1.80 | 258 | |
| 2-Phenoxyethanol | 1.19 | 245 | |
| Phenylacetaldehyde | 1.78 | 195 | |
| 2-Phenylethyl acetate | 2.13 | 235 | |
| Phenethyl alcohol | 1.18 | 218 | |
| Phenyl Ethyl dimethyl Carbinol (Benzyl-tert-butanol) | 2.42 | | 257 |
| Prenyl acetate | 1.68 | | 15o |
| Propyl butanoate | 2.30 | 143 | |
| (+)-Pulegone | 2.50 | 224 | |
| Rose oxide | 2.90 | | 197 |
| Safrole | 2.57 | 235 | |
| 4-Terpinenol | 2.75 | 211 | |
| Terpinolene (alpha-Terpineol) | 2.63 | 219 | |
| Veratrole (1,2-Dimethoxybenzene) | 1.60 | 206 | |
| Viridine (Phenylacetaldehyde dimethyl acetal) | 1.29 | 220 | |

TABLE 3

Examples of "Non Blooming" Perfume Ingredients

| Ingredient | ClogP (Pred.) | Boiling Pt. (Meas.) | Boiling Pt. (Pred.) |
|---|---|---|---|
| (Ambrettolide) | 6.36 | | 352 |
| Oxacycloheptadec-1O-en-2-one (Amyl benzoate) n-Pentyl benzoate | 4.23 | | 263 |
| Isoamyl cinnamate | 4.45 | | 300 |
| alpha-Amylcinnamaldehyde | 4.32 | 289 | |
| alpha-Amylcinnamaldehyde dimethyl acetal | 4.03 | | 320 |
| (iso-Amyl Salicylate) isopentyl salicylate | 4.43 | 277 | |
| (Aurantiol) Methyl anthranilate/hydroxycitronellal Schiff base | 4.22 | | 413 |
| Benzophenone | 3.18 | 305 | |
| Benzyl salicylate | 4.21 | 320 | |
| beta-Caryophyllene | 6.45 | | 263 |
| Cedrol | 4.53 | | 274 |
| Cedryl acetate | 5.48 | | 289 |
| Cinnamyl cinnamate | 4.64 | | 387 |
| Citronellyl isobutyrate | 5.04 | | 266 |
| Coumarin | 1.41 | 302 | |
| Cyclohexyl salicylate | 4.48 | | 327 |
| Cyclamen aldehyde | 3.46 | | 271 |
| delta-Dodecalactone | 4.39 | | 279 |
| (Dihydro Isojasmonate) Methyl 2-hexyl-3-oxo-cyclopentanecarboxylate | 3.09 | | 314 |
| Diphenylmethane | 4.06 | 265 | |
| Ethylene brassylate | 4.62 | | 390 |
| Ethyl methylphenylglycidate | 2.71 | 274 | |
| Ethyl undecylenate | 4.99 | 261 | |
| Ethyl Vanillin | 1.80 | 2.85 | |
| Isoeugenol | 2.58 | 266 | |
| Iso E Super | 4.85 | | 307 |
| (Exaltolide) Pentadecanolide | 6.29 | | 338 |
| (Galaxolide) 4,6,6,7,8,8-Hexamethyl-1,3,4,6,7,8-hexahydro-cyclopenta (G)-2-benzopyran | 6.06 | | 335 |
| gamma-Methyl Ionone (alpha-Isomethylionone) | 4.02 | | 278 |
| Geranyl isobutyrate | 5.00 | | 295 |
| Hexadecanolide | 6.85 | | 352 |
| cis-3-Hexenyl salicylate | 4.61 | | 323 |

TABLE 3-continued

Examples of "Non Blooming" Perfume Ingredients

| Ingredient | ClogP (Pred.) | Boiling Pt. (Meas.) | Boiling Pt. (Pred.) |
|---|---|---|---|
| alpha-Hexylcinnamaldehyde | 4.85 | | 334 |
| n-Hexyl salicylate | 5.09 | | 318 |
| alpha---Irone | 4.23 | | 279 |
| 6-Isobutylquinoline | 3.99 | | 294 |
| Lilial (p-tert.Butyl-alpha-methyldihydrocinnamic aldehyde, PT Bucinol) | 3.86 | | 282 |
| Linalyl benzoate | 5.42 | | 325 |
| (2-Methoxy Naphthalene) beta-Naphthyl methyl ether | 3.24 | 274 | |
| Methyl cinnamate | 2.47 | 262 | |
| Methyl dihydrojasmonate | 2.42 | | 314 |
| Methyl beta-naphthyl ketone | 2.76 | 302 | |
| 10-Oxahexadecanolide | 4.38 | | 355 |
| Patchouli alcohol | 4.53 | | 317 |
| (Phantolide) 5-Acetyl-1,1,2,3,3,6-hexamethylindan | 5.69 | | 333 |
| Phenethyl benzoate | 4.06 | | 335 |
| Phenethyl phenylacetate | 3.77 | | 350 |
| Phenyl Hexanol (3-Methyl-5-phenyl-1-pentanol) | 3.17 | | 296 |
| Phenoxy ethyl isobutyrate | 2.92 | | 277 |
| Tonalid (7-Acetyl-1,1,3,4,4,6-hexamethyltetralin) | 6.25 | | 344 |
| delta-Undecalactone | 3.86 | | 262 |
| gamma-Undecalactone | 3.83 | 286 | |
| Vanillin | 1.28 | 285 | |
| Vertinert Acetate | 5.47 | | 332 |

The perfumes suitable for use in the glass cleaning composition can be formulated from known fragrance ingredients and for purposes of enhancing environmental compatibility, the perfume is preferably substantially free of halogenated fragrance materials and nitromusks.

B. Surfactant System

The compositions of the present invention contain a detergent surfactant system selected from the group consisting of anionic surfactants, ampheteric detergent surfactants including zwitterionic surfactants; and mixtures thereof as described hereinafter. The surfactant system is present at a level of from about 0.001% to about 2%, preferably from about 0.02% to about 1%, and more preferably from about 0.05% to about 0.2%, by weight of the composition.

(1) The Amahocarboxylate Detergent Surfactant

The aqueous, liquid hard surface detergent compositions (cleaners) herein can contain from about 0.001% to about 2%, preferably from about 0.01% to about 0.5%, more preferably from about 0.02% to about 0.2%, and even more preferably from about 0.03% to about 0.08%, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to most of the zwitterionic detergent surfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic surfactants.

The "amphocarboxylate" detergent surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such detergent surfactants are available, for example: from Witco under the trade name Rewoteric AM-V®, having the formula $$C_7H_{15}C(O)NH(CH_2)_2N(CH_2CH_2OH)CH_2C(O)O^{(-)}Na^{(+)};$$

Mona Industries, under the trade name Monateric 1000®, having the formula $$C_7H_{15}C(O)NH(CH_2)_2N(CH_2CH_2OH)CH_2CH_2C(O)O^{(-)}Na^{(+)};$$

and Lonza under the trade name Amphoterge KJ-2®, having the formula $$C_{7,9}H_{15,19}C(O)NH(CH_2)_2N(CH_2CH_2OCH_2C(O)O^{(-)}Na^{(+)})CH_2C(O)O^{(-)}Na^{(+)}.$$

(2) Zwitterionic Detergent Surfactant

The aqueous, liquid hard surface detergent compositions (cleaners) herein can contain from about 0.001% to about 2% of suitable zwitterionic detergent surfactant containing a cationic group, preferably a quaternary ammonium group, and an anionic group, preferably carboxylate, sulfate and/or sulfonate group, more preferably sulfonate. A more preferred range of zwitterionic detergent surfactant inclusion is from about 0.02% to about 1% of surfactant, a most preferred range is from about 0.05% to about 0.2%.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3—[C(O)—N(R^4)—(CR^5_2)_n]_mN(R^6)_2^{(+)}—(CR^5_2)_p]—Y^{(-)}$$

wherein each Y is preferably a carboxylate (COO—) or sulfonate ($SO_3$—) group, more preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5_2)p^1$ group; wherein $(R^6)$ is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Witco Company as a 40% active product under the trade name "REWOTERIC AM CAS Sulfobetaine®."

The level of zwitterionic detergent surfactant, e.g., HASB, in the composition is typically from about 0.001% to about 2.0%, preferably from about 0.02% to about 1.0%. The level in the composition is dependent on the eventual level of dilution to make the wash solution. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

(3) Anionic and Optional Nonionic Detergent Surfactant

The detergent compositions, preferably aqueous, liquid hard surface detergent compositions, herein can contain, as the cosurfactant, less preferred, or Is the primary detergent surfactant, preferably, from about 0.001% to about 2.0%, preferably from about 0.01% to about 1.0% of suitable anionic detergent surfactant. The anionic surfactants are suitably water-soluble alkyl or alkylaryl compounds, the alkyl having from about 6 to about 20 carbons, and including a sulfate or sulfonate substituent group. Depending upon the level of cleaning desired one can use only the anionic detergent surfactant, or the anionic detergent surfactant can be combined with a cosurfactant, preferably an amphoteric cosurfactant.

The anionic detergent surfactants herein preferably have the generic formula:

$$R^9—(R^{10})_{0-1}—SO_3^{(-)}M^{(+)}$$

wherein $R^9$ is a $C_6$–$C_{20}$ alkyl chain, preferably a $C_8$–$C_{16}$ alkyl chain; $R^{10}$, when present, is a $C_6$–$C_{20}$ alkylene chain, preferably a $C_8$–$C_{16}$ alkylene chain, a $C_6H_4$ phenylene group, or O; and M is the same as before.

The most preferred compositions herein preferably contain from about 0.001% to about 2%, by weight of the composition, more preferably from about 0.01% to about 1%, most preferably from about 0.02% to about 0.3%, by weight of the composition, of one or more chainlengths of a linear alcohol sulfate detergent surfactant having the general formula:

$$R—O—SO_3M$$

wherein M is any suitable counterion, preferably sodium, potassium, etc.; and wherein R is an alkyl group with a chainlength of from about $C_8$ to about $C_{18}$ and mixtures thereof, preferably from about $C_{12}$ to about $C_{18}$ and mixtures thereof, more preferably from about $C_{14}$ to about $C_{18}$ and mixtures thereof, and wherein R is $C_{14}$ in more than about 30%, preferably more than about 35%, more preferably more than about 40%, by weight of the alkyl sulfate. The entire alkyl sulfate surfactant can contain R of $C_{14}$ and longer chainlength(s), but more than 30%, by weight of the alkyl surfactant preferably must be a $C_{14}$ chainlength. Compositions containing only alkyl sulfate surfactants with higher chainlengths, i.e., $C_{16-18}$ provide good surface lubricity benefits. However, these chain lengths, without the required amount of $C_{14}$ chainlengths, exhibit poor filming/streaking properties. On the other hand, compositions which are solely made up of lower-chain alkyl sulfate surfactants, i.e., $C_{8-12}$ alkyl sulfate surfactants, provide acceptable filming/streaking properties but show poor surface lubricity properties. The presence of the $C_{14}$ chainlength at levels of more than about 30%, by weight of the alkyl sulfate surfactant, in combination with other chainlengths, or alone, provide a product with both excellent surface lubricity properties and excellent filming/streaking properties. Particularly preferred compositions contain from about 0.05% to about 0.30%, by weight of the composition, of a $C_{12/14}$ blend in which the $C_{12}$ to $C_{14}$ weight ratio is from about 1:10 to about 2:1, preferably from about 1:5 to about 1.5:1, and more preferably from about 1:3 to about 1:1. This combination has been found to provide sufficient surface lubricity while avoiding objectionable filming/streaking. The alcohol sulfate detergent raw materials selected are essentially free from unreacted fatty alcohol wherein the term "essentially free" is defined as having less than about 2%, by weight of the composition, preferably less than about 1.8%, and more preferably less than about 1.5%, by weight of the composition of unreacted fatty alcohol in a nominally 30% active raw material.

A most preferred alkyl sulfate surfactant is a mixture of Stepanol WA-Extra®, available from the Stepan Company, with extra $C_{14}$ alkyl sulfate added such that the $C_{12/14}$ ratio is nearly 1:1.

Concentrated compositions can also be used in order to provide a less expensive product. When a higher concentration is used, i.e., when the level of alkyl sulfate surfactant used is from about 0.10% to about 2.0%, by weight of the composition, it is preferable to dilute the composition before using it to clean a hard surface, especially glass. Dilution ratios of the alkyl sulfate concentrate(s) to water can range, preferably, from about 1:1 to 1:10, more preferably from about 1:1.5 to 1:5, and most preferably from about 1:2 to 1:5.

Some suitable surfactants for use herein in small amounts are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol® 15-S-3, Tergitol® 15-S-5, Tergitol® 15-S-7, and Tergitol® 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

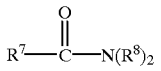

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129®, a potassium fluorinated alkylcarboxylate and FC-170-C®, a mixture of fluorinated alkyl polyoxyethylene ethanols, both available from 3M Corporation, as well as the Zonyl® fluorosurfactants, available from DuPont Corporation. It is understood that mixtures of various surfactants can be used.

Nonionic surfactants, e.g., ethoxylated alcohols and/or alkyl phenols, can also be used as cosurfactants.

(4) Mixtures

Mixtures of amphocarboxylate, zwitterionic detergent surfactants, and/or anionic detergent surfactants as discussed hereinbefore, can be present in the present invention. The zwitterionic detergent surfactants can be present at levels from about 0.02% to about 1.5%. The amphocarboxylate detergent surfactants cam be present at levels from about 0.001% to about 1.5%. The ratio of zwitterionic detergent surfactant to amphocarboxylate detergent surfactant is typically from about 3:1 to about 1:3, preferably from about 2:1 to about 1:2, more preferably about 1:1. The ratio of primary detergent surfactant to cosurfactant, or cosurfactants, is typically from about 3:1 to about 1:1.

C. Hydrophobic Solvent

In order to improve cleaning in liquid compositions, one can use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T \left[\frac{a-1}{a}\right]^{1/2}$$

Wherein γH is the hydrogen bonding parameter, a is the aggregation number, $$(\text{Log } \alpha = 3.39066\ T_b/T_c - 0.15848 - \text{Log}\underline{M}), \text{ and } {}_d$$

γT is the solubility parameter which is obtained from the formula:

$$\gamma T = \left[\frac{(\Delta H_{25} - RT)d}{M}\right]^{1/2}$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7, or 7.7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used at a level of from about 0.5% to about 30%, preferably from about 2% to about 15%, more preferably from about 3% to about 8%. Dilute compositions typically have solvents at a level of from about 1% to about 10%, preferably from about 3% to about 6%. Concentrated compositions contain from about 10% to about 30%, preferably from about 10% to about 20% of solvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, glycol ethers useful herein have the formula $R^{11}$ O—($R^{12}$O—)$_m$1H wherein each $R^{11}$ is an alkyl group which contains from about 3 to about 8 carbon atoms, each $R^{12}$ is either ethylene or propylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure.

Preferred diol solvents have a solubility in water of from about 0.1 to about 20 g/100 g of water at 20° C.

(D) Aqueous Solvent System

The balance of the formula is typically water and non-aqueous polar solvents with only minimal cleaning action like methanol, ethanol, isopropanol, ethylene glycol, glycol ethers having a hydrogen bonding parameter of greater than 7.7, propylene glycol, and mixtures thereof, preferably ethanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of water is from about 50% to about 99%, preferably from about 75% to about 95%.

(E) Optical Ingredients (1) Optional soluble carbonate and/or bicarbonate salts

Water-soluble alkali metal carbonate and/or bicarbonate salts, such as sodium bicarbonate, potassium bicarbonate, potassium carbonate, cesium carbonate, sodium carbonate, and mixtures thereof, are added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof. Solubilized, water-soluble alkali metal carbonate and bicarbonate salts are typically present at a level of from about 0% to about 0.5%, preferably from about 0.005% to about 0.1%, more preferably from about 0.01% to about 0.1%, and most preferably from about 0.02% to about 0.05% by weight of the composition. The pH in the composition, at least initially, in use is from about 7 to about 11, preferably from about 7.5 to about 10.5, more preferably from about 8 to about 10. pH is typically measured on the product.

(2) Optional tartaric acid/monoethanolamine salt

Detergent builders that are efficient for hard surface cleaners and have reduced filming/streaking characteristics at the critical levels can also be employed in the present invention. Addition of the specific detergent builder tartaric acid at critical levels to the present composition improves cleaning without the problem of filming/streaking that usually occurs when detergent builders are added to hard surface cleaners. Through the present invention there is no longer the need to make a compromise between improved cleaning and acceptable filming/streaking results which is especially important for hard surface cleaners which are also directed at cleaning glass. These compositions containing the detergent builder herein at the levels herein, have exceptionally good cleaning properties. They also have exceptionally good shine properties, i.e., when used to clean glossy surfaces, without rinsing, they have much less tendency than, e.g., carbonate built products to leave a dull finish on the surface and filming/streaking.

The tartaric acid detergent builder is present at levels of from about 0.001% to about 0.1%. more preferably from about 0.01% to about 0.1%, and most preferably from about 0.01% to about 0.05%. The salts are preferably compatible and include ammonium, sodium, potassium and/or alkanolammonium salts. The alkanolammonium salt is preferred. The preferred alkanolammonium salt is that formed by the addition of monoethanolamine (MEA) at a level of from about 0.005% to about 0.2%, preferably from about 0.01% to about 0.1%, more preferably from about 0.02% to about 0.1% by weight of the composition.

(3) Optional Substantive Ingredients

An optional part of this invention is a substantive material that improves the hydrophilicity of the surface being treated, especially glass. This increase in hydrophilicity provides improved appearance when the surface is rewetted and then dried. The water "sheets" off the surface and thereby minimizes the formation of, e.g., "rainspots" that form upon drying. Substantive materials useful in the present invention include amine oxide polymers, polycarboxylate, polystyrene sulfonate, and polyether based polymers. The level of substantive polymer should normally be from about 0.01% to about 1%, preferably from about 0.05% to about 0.5%, more preferably from about 0.1% to about 0.3%, by weight of the composition.

The use of polycarboxylate, polystyrene sulfonate, and polyether based polymers to provide this hydrophilicity is known in the art. The use of these polymers is described in P&G Copending application Ser. No. 08/378,205, filed Jan. 25, 1995, Masters, et al., which is herein incorporated by reference.

The optional amine oxide polymers of this invention have one or more monomeric units containing at least one N-oxide group. At least about 10%, preferably more than about 50%, more preferably greater than about 90% of said monomers forming said polymers contain an amine oxide group. These polymers can be described by the general formula:

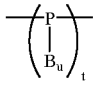

wherein each P is selected from homopolymerizable and copolymerizable moieties which attach to form the polymer backbone, preferably vinyl moieties, e.g. $C(R)_2—C(R)_2$, wherein each R is H, $C_1$–$C_{12}$ (preferably $C_1$–$C_4$) alkyl(ene), $C_6$–$C_{12}$ aryl(ene) and/or B; B is a moiety selected from substituted and unsubstituted, linear and cyclic $C_1$–$C_{12}$ alkyl, $C_1$–$C_{12}$ alkylene, $C_1$–$C_{12}$ heterocyclic, aromatic $C_6$–$C_{12}$ groups and wherein at least one of said B moieties has at least one amine oxide (≡N→O) group present; u is from 0 to about 2; and t is number such that the average molecular weight of the polymer is from about 2,000 to about 100,000, preferably from about 5,000 to about 20,000, and more preferably from about 8,000 to about 12,000.

The preferred optional polymers of this invention possess the unexpected property of being substantive without leaving a visible residue that would render the glass surface unappealing to consumers. The preferred polymers include poly(4-vinylpyridine N-oxide) polymers (PVNO), e.g. those formed by polymerization of monomers that include the following moiety:

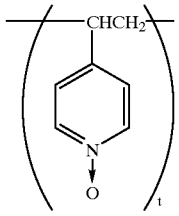

wherein, for the purposes of this invention, t is a number such that the average molecular weight of the polymer is from about 2,000 to about 100,000, preferably from about 5,000 to about 20,000, and more preferably from about 8,000 to about 12,000. The desirable molecular weight range of polymers useful in the present invention stands in contrast to that found in the art relating to polycarboxylate, polystyrene sulfonate, and polyether based additives which prefer molecular weights in the range of 400,000 to 1,500,000.

(F) Optional Minor Ingredients

The compositions herein can also contain other various adjuncts which are known to the art for detergent compositions. Preferably they are not used at levels that cause unacceptable filming/streaking. Non-limiting examples of such adjuncts are:

Hydrotropes such as sodium toluene sulfonate, sodium cumene sulfonate and potassium xylene sulfonate; and Aesthetic-enhancing ingredients such as colorants providing they do not adversely impact on filming/streaking in the cleaning of glass.

Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Stabilizing ingredients can be present typically to stabilize more of the hydrophobic ingredients, e.g., perfume. The stabilizing ingredients include acetic acid and propionic acids, and their salts, e.g., $NH_4$, MEA, Na, K, etc., preferably acetic acid and the $C_2$–$C_6$ alkane diols, more preferably butane diol. The stabilizing ingredients do not function in accordance with any known principle. Nonetheless, the combination of amido zwitterionic detergent surfactant with linear acyl amphocarboxylate detergent surfactant, anionic detergent surfactant, nonionic detergent surfactant, or mixtures thereof, and stabilizing ingredient can create a microemulsion. The amount of stabilizing ingredient is typically from about 0.01% to about 0.5%, preferably from about 0.02% to about 0.2%. The ratio of hydrophobic material, e.g., perfume that can be stabilized in the product is related to the total surfactant and typically is in an amount that provides a ratio of surfactant to hydrophobic material of from about 1:2 to about 2:1.

Other detergent builders that are efficient for hard surface cleaners and have reduced filming/streaking characteristics at the critical levels can also be present in the compositions of the invention.

Suitable additional optional detergent builders include salts of ethylenediaminetetraacetic acid (hereinafter EDTA), citric acid, nitrilotriacetic acid (hereinafter NTA), sodium carboxymethylsuccinic acid, sodium N-(2-hydroxypropyl)-iminodiacetic acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), and a most preferred builder is EDTA (e.g., sodium).

These additional optional detergent builders, when present, are typically at levels of from about 0.05% to about 0.5%. more preferably from about 0.05% to about 0.3%, most preferably from about 0.05% to about 0.15%. The levels of these additional builders present in the wash solution used for glass should be less than about 0.2%. Therefore, typically, dilution is highly preferred for cleaning glass, while full strength is preferred for general purpose cleaning, depending on the concentration of the product.

Typically the best filming/streaking results occurs most when the builder is combined with amphoteric and/or zwitterionic detergent surfactant compositions although an improvement is also seen with the less preferred anionic or anionic/nonionic detergent surfactant compositions.

In order to make the present invention more readily understood, reference is made to the following examples, which are intended to be illustrative only and not intended to be limiting in scope.

| Perfume Ingredients | Wt. % |
|---|---|
| PERFUME A - Citrus Floral | |
| Blooming Ingredients | |
| Phenyl Hexanol | 3 |
| Citronellol | 5 |
| Citronellyl Nitrile | 3 |
| para Cymene | 2 |
| Decyl Aldehyde | 1 |
| Dihydro Myrcenol | 15 |
| Geranyl Nitrile | 5 |
| alpha-Ionone | 2 |
| Linalyl Acetate | 5 |
| α Pinene | 3 |
| beta-Myrcene | 1.5 |
| d Limonene | 15 |
| beta-Pinene | 3 |
| Delayed Blooming Ingredients | |
| Anisic Aldehyde | 1 |
| beta gamma Hexenol | 0.3 |
| cis-3-Hexenyl Acetate | 0.2 |
| cis-Jasmone | 1 |
| Linalool | 8 |
| Nerol | 3 |
| Citral | 4 |
| 4-Terpineol | 4 |
| Other Ingredients | |
| Amyl Salicylate | 1 |
| Hexyl Cinnamic Aldehyde | 5 |
| Hexyl Salicylate | 3 |
| P. T. Bucinal | 5 |
| Patchouli alcohol | 1 |
| Total | 100 |
| PERFUME B - Rose Floral | |
| Blooming Ingredients | |
| Citronellol | 15 |
| Citronellyl Nitrile | 3 |
| Decyl Aldehyde | 1 |
| Dihydro Myrcenol | 4 |
| Dimethyl Octanol | 5 |
| Diphenyl Oxide | 1 |
| Geranyl Acetate | 3 |
| Geranyl Formate | 3 |
| alpha-Ionone | 3 |
| Isobornyl Acetate | 4 |
| Linalyl acetate | 4 |
| Citronellyl acetate | 5 |
| Delayed Blooming Ingredients | |
| Geraniol | 6 |
| Phenyl Ethyl Alcohol | 13 |
| Terpineol | 4 |
| Other Ingredients | |
| Aurantiol | 3 |
| Benzophenone | 3 |
| Hexyl Cinnamic Aldehyde | 10 |
| Lilial | 10 |
| Total | 100 |
| PERFUME C - Woody Floral, Powdery | |
| Blooming Ingredients | |
| Carvacrol | 1 |
| Citronellol | 5 |
| Isobornyl Acetate | 8 |
| alpha ionone | 5 |
| beta-Myrcene | 1 |
| alpha-Pinene | 4 |
| beta-Pinene | 3 |
| Tetrahydro Myrcenol | 6 |
| Verdox | 2.8 |

-continued

| Perfume Ingredients | Wt. % |
|---|---|
| Vertenex | 10 |
| Allyl Ocimene | 0.3 |
| Delayed Blooming Ingredients | |
| Anisic Aldehyde | 3 |
| Camphor gum | 2 |
| Cinnamic Aldehyde | 2 |
| para-Cresyl Methyl Ether | 0.1 |
| cis-Jasmone | 0.5 |
| Veridine | 5 |
| Other Ingredients | |
| Cedrol | 3 |
| Cedryl Acetate | 2 |
| Coumarin | 6 |
| Ethyl Vanillin | 0.3 |
| Galaxolide 50% in IPM | 5 |
| Hexyl Cinnamic Aldehyde | 5 |
| Isoeugenol | 2 |
| Lilial | 8 |
| Methyl Cinnamate | 3 |
| Patchouli alcohol | 3 |
| Vetivert Acetate | 4 |
| Total | 100 |
| PERFUME D - Fruity Floral | |
| Blooming Ingredients | |
| Allyl Heptoate | 2 |
| Citronellyl Nitrile | 3 |
| Dihydro Myrcenol | 5 |
| Limonene | 5 |
| Geranyl Nitrile | 2 |
| alpha-Ionone | 4 |
| Linalyl Acetate | 8 |
| Methyl Chavicol | 0.5 |
| d-Limonene | 15 |
| Verdox | 2 |
| Tetrahydrolinool | 5 |
| Delayed Blooming Ingredients | |
| Anisic Aldehyde | 2 |
| Ethyl Acetate | 1 |
| Ethyl Benzoate | 1 |
| Linalool | 3 |
| Methyl Anthranilate | 5 |
| Citral | 2 |
| delta Nonalactone | 1 |
| Other Ingredients | |
| Aurantiol | 2 |
| Ethylene Brassylate | 2 |
| Galaxolide 50 IPM | 10 |
| Hexyl Salicylate | 5 |
| Iso E Super | 5 |
| Phenoxy Bthyl Isobutyrate | 9.5 |
| Total | 100 |

Perfume E is especially stable for compositions with compositions which contain bleaches.

| Perfume Ingredients | Wt. % |
|---|---|
| PERFUME E - Fruity Lemon | |
| Blooming Ingredients | |
| Dihydro Myrcenol | 1 |
| Alpha Pinene | 2.5 |
| para-Cymene | 0.5 |
| Isononyl Alcohol | 0.5 |
| Tetrahydro Linalool | 45 |
| d-Limonene | 44 |
| Verdox | 1 |

-continued

| Perfume Ingredients | Wt. % |
|---|---|
| Delayed Blooming Ingredients | |
| Camphor gum | 0.5 |
| Dimethyl Benzyl Carbinol | 1 |
| Eucalyptol | 1 |
| Fenchyl Alcohol | 1.5 |
| Dimetol | 1.5 |
| Total | 100 |
| PERFUME F - Citrus Lime | |
| Blooming Ingredients | |
| Citronellyl Nitrile | 2 |
| Decyl Aldehyde | 0.5 |
| Dihydro Myrcinol | 10 |
| Geranyl Nitrile | 3 |
| Linalyl Acetate | 5 |
| d-Limonene | 30 |
| para-Cymene | 1.5 |
| Phenyl Hexanol | 5 |
| alpha-Pinene | 2.5 |
| Terpinyl Acetate | 2 |
| Tetrahydro Linalool | 3 |
| Verdox | 1 |
| Delayed Bloomming Ingredients | |
| Benzyl Propionate | 2 |
| Eucalyptol | 2 |
| Fenchyl Alcohol | 0.5 |
| Flor Acetate | 7 |
| cis-3-hexyl tiglate | 0.5 |
| Linalool | 7 |
| 4-Terpineol | 2 |
| Citral | 3 |
| Octyl aldehyde | 0.5 |
| Frutene | 5 |
| Other Ingredients | |
| Methyl Dihydro Jasmonate | 5 |
| Total | 100 |
| PERFUME G - Citrus Fruity Floral | |
| Blooming Perfume Ingredients | |
| Allyl Heptoate | 1.20 |
| Beta Pinene | 1.20 |
| Camphene | 1.20 |
| Citronellal Nitrile | 2.40 |
| Citronellol | 6.10 |
| Citronellyl Propionate | 3.00 |
| Decyl Aldehyde | 0.60 |
| Dihydro Myrcenol | 6.10 |
| Geranyl Acetate | 1.20 |
| Iso Bornyl Acetate | 3.60 |
| limonene | 3.60 |
| Linalyl Acetate | 2.40 |
| Orange Terpenes | 12.10 |
| Rhodinol 70 | 3.60 |
| Terpinyl Acetate | 2.40 |
| Tetra Hydro Linalool | 2.40 |
| Thymol NF | 1.20 |
| Verdox | 2.40 |
| Delayed Blooming Perfume Ingredients | |
| Allyl Caproate | 1.20 |
| Benzyl Alcohol | 2.40 |
| Citral | 2.40 |
| Flor Acetate | 2.80 |
| Frutene | 1.50 |
| Hydroxycitronellal | 6.10 |
| Methyl Anthranilate | 3.60 |
| Nerol | 6.10 |
| Phenyl Ethyl Alcohol | 12.30 |
| Terpineol | 4.90 |
| Total | 100 |

EXAMPLE I

| INGREDIENT | Formula 1 Wt. % | Formula 2 Wt. % |
|---|---|---|
| Butoxypropanol | 2.8 | 2.8 |
| Ethanol | 2.8 | 2.8 |
| Sodium Dodecyl Sulfate | 0.13 | 0.20 |
| Sodium Tetradecyl Sulfate | 0.11 | 0.08 |
| $NaHCO_3$ | 0.02 | 0 |
| $NaCO_3$ | 0.02 | 0 |
| Perfume A | 0.05 | |
| Perfume B | | 0.10 |
| Water | balance | balance |

EXAMPLE II

| Formula Component | 3 | 4 | 5 | 6 | 7 |
|---|---|---|---|---|---|
| Isopropanol | 2.00 | 4.00 | — | — | 2.00 |
| Ethanol | — | — | 2.00 | 5.00 | — |
| Butoxypropanol | 3.00 | 1.50 | 2.50 | 1.00 | 4.00 |
| $C_{12}$ Alkyl Sulfate | 0.20 | — | — | — | — |
| $C_{14}$ Alkyl Sulfate | 0.08 | — | — | — | 0.10 |
| Cocoamidopropylbetaine | — | 0.20 | — | — | 0.10 |
| Linear Alkyl ($C_8$–$C_{18}$) Benzene Sulfonate | — | — | — | 0.10 | — |
| Sodium Laureth Sulfate | — | — | — | 0.25 | — |
| Alcohol Ethoxylate (Neodol ® 91-6) | — | — | 0.04 | — | — |
| Sodium Bicarbonate | — | 0.02 | — | 0.06 | 0.04 |
| Monoethanolamine | — | — | 0.1 | — | |
| Tartaric Acid | — | — | 0.03 | — | — |
| Perfume A | 0.20 | — | — | — | — |
| Perfume B | — | 0.05 | — | — | — |
| Perfume C | — | — | — | 0.025 | — |
| Perfume D | — | — | 0.05 | — | — |
| Perfume E | — | — | — | — | 0.025 |
| PVNO (avg MW ~ 10,000) | — | 0.15 | 0.25 | — | — |
| Water | balance | balance | balance | balance | balance |

What is claimed is:

1. An aqueous, liquid, hard surface detergent composition having improved cleaning and good filming/streaking characteristics comprising:

(A) from about 0.001% to about 3% of a blooming perfume composition comprising at least about 50% of blooming perfume ingredients selected from the group consisting of: ingredients having a boiling point of less than about 260° C. and a ClogP of at least about 3, and wherein said perfume composition comprises at least 5 different blooming perfume ingredients;

(B) from about 0.001% to about 2% of detergent surfactant system selected from the group consisting of anionic surfactants, amphoteric detergent surfactants including zwitterionic surfactants; and mixtures thereof; and (C) from about 0.5% to about 30% of hydrophobic solvent;

(D) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients.

2. The composition of claim 1 wherein said blooming perfume composition does not contain any single ingredient at a level of more than about 60% by weight of the perfume composition.

3. The composition of claim 2 wherein component (B) is selected from the group consisting of:

(1) from about 0.001% to about 2% detergent surfactant having the generic formula:

$$RN(R^1)(CH_2)_nN(R^2)(CH_2)_pC(O)OM$$

wherein R is a $C_6$–$C_{10}$ hydrophobic moiety, including fatty acyl moiety containing from about 6 to about 10 carbon atoms which in combination with the nitrogen atom forms an amido group, $R^1$ is hydrogen or a $C_{1-2}$ alkyl group, $R^2$ is a $C_{1-2}$ alkyl, carboxymethoxy ethyl, or hydroxy ethyl, each n is an integer from 1 to 3, each p is an integer from 1 to 2 and M is a water soluble cation selected from alkali metal, ammonium, alkanolammonium, and mixtures thereof cations;

(2) from about 0.001% to about 2% detergent surfactant having the generic formula:

$$R^3—[C(O)—N(R^4)—(CR^5{}_2)_n1—]_mN(R^6)_2{}^{(+)}—(CR^5{}_2)_p1—Y^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any $(CR^5{}_2)_p{}^1$ moiety; m is 0 or 1; each $n^1$ and $p^1$ is a number from 1 to about 4; and Y is a carboxylate or sulfonate group;

(3) from about 0.001% to about 2.0% detergent surfactant having the generic formula:

$$R^9—(R^{10})_{0-1}—SO_3{}^{(-)}M^{(+)}$$

wherein $R^9$ is a $C_6$–$C_{20}$ alkyl chain; $R^{10}$ is a $C_6$–$C_{20}$ alkylene chain, a $C_6H_4$ phenylene group, or O; and M is the same as before; and (4) mixtures thereof.

4. The composition of claim 3 wherein the blooming perfume ingredients are selected from the group consisting of: Allo-Ocimene, allyl cyclohexanepropionate, Allyl Heptoate, trans Anethol, Benzyl Butyrate, Camphene, Cadinene, Carvacrol, cis-3-Hexenyl Tiglate, Citronellol, Citronellyl Acetate, Citronellyl Nitrile, Citronellyl Propionate, Cyclohexyl Ethyl Acetate, Decyl Aldehyde, Dihydromycernol, Dihydromyrcenyl Acetate, 3,7 dimethyl-1-Octanol, Diphenyl Oxide, Fenchyl Acetate, Geranyl Acetate, Geranyl Formate, Geranyl Nitrile, cis-3-Hexenyl Isobutyrate, Hexyl Neopentanoate, Hexyl Tiglate, alpha-Ionone, Isobornyl Acetate, Isobutyl Benzoate, Isononyl Acetate, Isononyl Alcohol, Isopulegyl acetate lauraldehyde, d-Limonene, Linalyl Acetate, (–)-L-Menthyl Acetate, Methyl Chavicol, Methyl -n-Nonyl Acetaldehyde, Methyl Octyl Acetaldehyde, beta-Myrcene, Neryl Acetate, Nonyl Acetate, Nonyl Aldehyde, para-Cymene, alpha-Pinene, beta-Pinene, alpha-Terpinene, gamma-Terpinene, alpha-Terpinyl acetate, Tetrahydro Linalool, Tetrahydro Myrcenol, 2-Undecenal, Veratrol, Verdox, and Vertenex.

5. The composition of claim 3 wherein said blooming perfume composition also includes delayed blooming perfume ingredients selected from the group consisting of perfume ingredients having a boiling point of less than about 260° C. and a ClogP of less than about 3, wherein the ratio of blooming perfume ingredients to delayed blooming ingredients is at least 1:1.

6. The composition of claim 5 wherein the delayed blooming perfume ingredients are selected from the group consisting of: Allyl Caproate, Amyl Acetate, Amyl Propionate, p-anisaldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, (+)-Camphor, (+)-Carvone, L-Carvone, Cinnamic Alcohol, Cinnamyl Formate, cis-Jasmone, cis-3-Hexenyl Acetate, Citral, Cumic alcohol, Cuminic aldehyde, Cyclal, Dimethyl Benzyl Carbinol, Dimethyl Benzyl Carbinyl Acetate, Ethyl Acetate, Ethyl acetoacetate, Ethyl Amyl Ketone, Ethyl Benzoate, Ethyl butanoate, Ethyl Hexyl Ketone, Ethyl Phenyl Acetate, Eucalyptol, Eugenol, Fenchyl Alcohol, Flor Acetate, Frutene, gamma Nonalactone, trans-Geraniol, cis-3-Hexen-1-ol, Hexyl Acetate, Hexyl Formate, Hydratropic Alcohol, Hydroxycitronellal, Indole, Isoamyl Alcohol, Isopulegol, isopropylphenylacetate, Isoquinoline, Ligustral, Linalool, Linalool Oxide, Linalyl Formate, Menthone, 4-Methyl Acetophenone, Methyl Pentyl Ketone, Methyl Anthranilate, Methyl Benzoate, Methyl Phenyl Carbinyl Acetate, Methyl Eugenol, Methyl Heptenone, Methyl Heptine Carbonate, Methyl Heptyl Ketone, Methyl Hexyl Ketone, Methyl Salicylate, Dimethyl Anthranilate, Nerol, gamma-Octalactone, 2-Octanol, Octyl Aldehyde, para-Cresol, para-Cresyl Methyl Ether, Acetanisole, 2-Phenoxy Ethanol, Phenyl Acetaldehyde, 2-Phenyl Ethyl Acetate, Phenyl Ethyl Alcohol, Phenyl Ethyl Dimethyl Carbinol, Prenyl Acetate, Propyl Butanoate, (+)-Pulegone, Rose Oxide, Safrole, 4-Terpinenol, Terpolene, Veratrole, and Veridine.

7. The composition of claim 1 wherein the blooming perfume composition has at least 55% of blooming perfume ingredients.

8. The composition of claim 7 wherein the blooming perfume composition has at least 60% of blooming perfume ingredients.

9. The composition of claim 8 wherein the blooming perfume composition has at least 70% of blooming perfume ingredients.

10. The composition of claim 1 wherein the level of said blooming perfume composition is from about 0.01% to about 1% by weight of the total composition.

11. The composition of claim 10 wherein the level of said blooming perfume composition is from about 0.01% to about 0.5%.

12. The composition of claim 11 wherein the blooming perfume composition has at least 70% of blooming perfume ingredients.

13. The process of cleaning glass with an effective amount of the composition of claim 1.

* * * * *